United States Patent [19]

Dilger et al.

[11] Patent Number: 5,072,474

[45] Date of Patent: Dec. 17, 1991

[54] BRIDGE CONSTRUCTION

[76] Inventors: Walter H. Dilger, 592 Dalmeny Hill N.W., Calgary, Alberta, Canada, T3A 1T6; Gamil S. Tadros, c/o #210, 2003 McKnight Blvd. N.E., Calgary, Alberta, Canada, T2E 6L2; David Calder, c/o 145 West First Avenue, Vancouver, B.C., Canada, V5Y 1A2; Paul B. Giannelia, c/o 1177 - 11th Avenue S.W., Calgary, Alberta, Canada, T2R 1K9

[21] Appl. No.: 551,861

[22] Filed: Jul. 12, 1990

[30] Foreign Application Priority Data

Jul. 12, 1989 [CA] Canada ..... 605489

[51] Int. Cl.[5] ..... E01D 11/00

[52] U.S. CL. ..... 1477/1; 14/18; 14/23

[58] Field of Search ..... 14/18, 19, 23, 6, 7, 14/8, 1; 405/209, 205, 206, 200, 201

[56] References Cited

U.S. PATENT DOCUMENTS

| | | | |
|---|---|---|---|
| 2,528,089 | 10/1950 | Siecke et al. | 405/205 |
| 3,145,539 | 8/1964 | Estes et al. | 405/205 X |
| 3,605,669 | 9/1971 | Yu | 405/200 X |
| 4,535,498 | 8/1985 | Webster | 14/18 |
| 4,646,379 | 3/1987 | Muller | 14/23 |
| 4,651,375 | 3/1987 | Maechi | 14/7 |
| 4,662,019 | 5/1987 | Muller | 14/18 X |
| 4,799,279 | 1/1989 | Muller | 14/18 X |
| 4,987,629 | 1/1991 | Muller | 14/6 |

FOREIGN PATENT DOCUMENTS

| | | | |
|---|---|---|---|
| 1437689 | 3/1966 | France | 405/200 |
| 711225 | 1/1980 | U.S.S.R. | 14/23 |

*Primary Examiner*—Hoang C. Dang

[57] ABSTRACT

The invention relates to a method of constructing a cable-stayed bridge extending between at least three towers. Initially, a horizontally extending truss spanning from a first tower to a second tower is moved longitudinally to be projected from the second tower to a third tower. The truss is then elevated. A plurality of stay cables are then strung from an elevated location on the second tower to a series of temporary connections to the truss on both sides of the second tower. A deck portion is then constructed on the truss on both sides of the second tower, and the cables that are not connected to the truss are connected to this deck portion. Finally, the cables are disconnected from the truss and the truss and hence the deck portion are lowered, causing the cables to support the weight of the deck and to acquire the desired tensional stresses. The procedure is faster than hitherto know methods of constructing this type of bridge. The truss, which could be used to aid in the construction of any bridge over a body of water, has air filled tanks that can be moved vertically. This enables the tanks to be lowered and submerged in the body of water to provide upward supporting forces on the truss while it extends between the towers.

13 Claims, 5 Drawing Sheets

11
21
10d
10c
20
13
12
10b
21
10a 14
21
10d
10c
20
20a
21
17

21
30
10d
20
17a
19
10c
17
20a
21
10b
19

BRIDGE CONSTRUCTION

FIELD OF THE INVENTION

This invention relates to the construction of bridges and more particularly cable-stayed bridges.

PRIOR ART

Conventionally, there are two methods of constructing cable-stayed bridges. One method involves sequentially casting short segments in place. The other method involves lifting short precast segments into place. Both methods require subsequent stressing of the cables to support each segment, and both methods are very time consuming.

SUMMARY OF THE INVENTION

An object of the present invention is to provide an improved method of constructing a cable-stayed bridge, and particularly a method that enables the bridge to be built much more rapidly than has been possible in the past.

To this end, the invention in its broad aspect provides a method of constructing a cable-stayed bridge, such method comprising the steps of erecting a truss on a tower, extending at least one stay cable (preferably all or nearly all the stay cables) from an elevated location on the tower to a temporary connection to the truss, constructing a deck on the truss and effecting a connection of the cable to this deck, and then disconnecting the cable from the truss and lowering the truss and hence the deck to tension the cable.

In a more specific form, the invention consists of a method of constructing a cable-stayed bridge extending between at least three towers, comprising the steps of causing a horizontally extending truss spanning from a first tower to a second tower to be moved longitudinally to be projected from the second tower to a third tower whereby to span between the latter towers while continuing to span between the first and second towers, elevating the truss relative to the second tower, extending a plurality of stay cables from an elevated location on the second tower to a series of temporary connections to the truss on both sides of the second tower, i.e. on the sides respectively extending towards the first and third towers, constructing a first deck portion extending along the truss on said sides of the second tower and effecting connections of the cables to this deck portion, and disconnecting the cables from the truss and lowering the truss and hence the deck portion relative to the second tower to cause the cables to support the weight of the deck portion and to acquire desired tensional stresses.

The construction of the bridge can be continued by causing the truss to be moved further longitudinally, i.e. to be projected from the third tower to a fourth tower whereby to span between the third and fourth towers while continuing to span between the second and third towers, again elevating the truss, and again extending a further plurality of stay cables from an elevated location on the third tower to a series of temporary connections to the truss on both sides of the third tower. A further deck portion is then constructed to extend along the truss on both sides of the third tower, and the further cables are connected to the further deck portion. The further cables are then disconnected from the truss and the truss is lowered again together with the further deck portion. This causes the further cables to support the weight of the further deck portion and to acquire desired tensional stresses, while aligning the further deck portion as a horizontal continuation of the first deck portion.

The invention also relates to a truss for use in one of the foregoing methods, or for use in the construction of bridges generally, not necessarily cable-stayed bridges.

In this aspect, the invention consists of a truss suitable for constructing a bridge over a body of water to extend between at least two towers, such truss having the purpose of providing a temporary support for the formation of a deck. The truss is fitted with air filled tanks and mechanisms for moving these tanks vertically relatively to the truss. This enables the tanks to be lowered and submerged in the body of water, which provides upward supporting forces on the truss while the truss is in position spanning the towers.

Specific examples of how the invention can be carried into practice are illustrated in the drawings and will now be described below.

DETAILED DESCRIPTION OF THE PREFERRED EMBODIMENTS

Figures 1A, 1B, 1C:
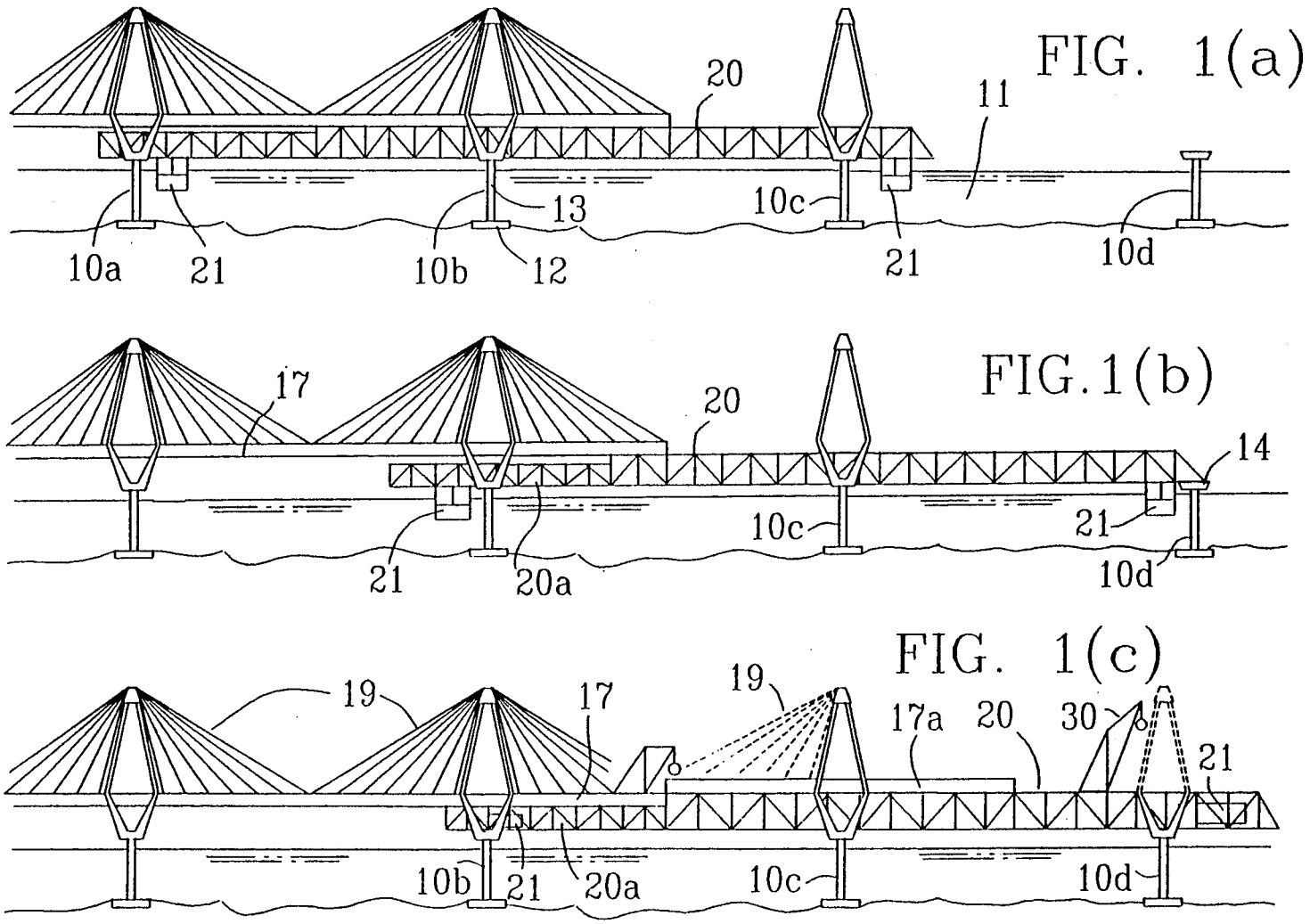
FIGS. 1(*a*), (*b*) and (*c*) respectively show three successive stages in the construction of a bridge according to an embodiment of the present invention.
Figure 2:
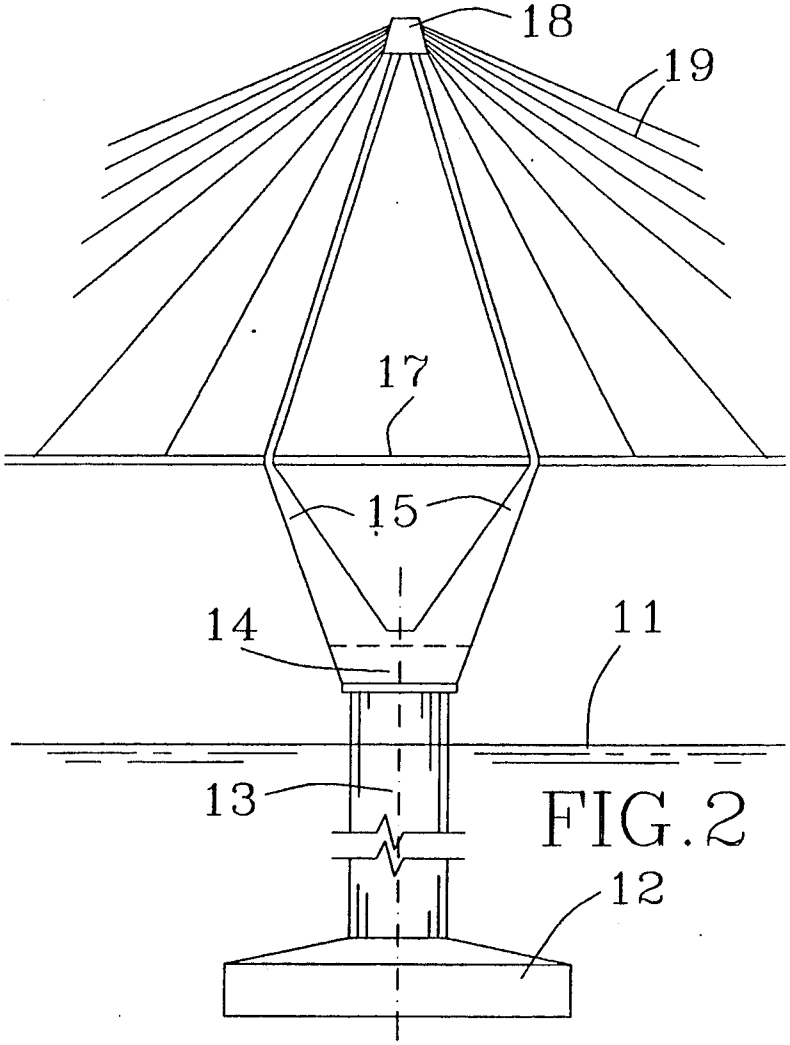
FIG. 2 is a front view of a tower used in such construction.
Figure 3:
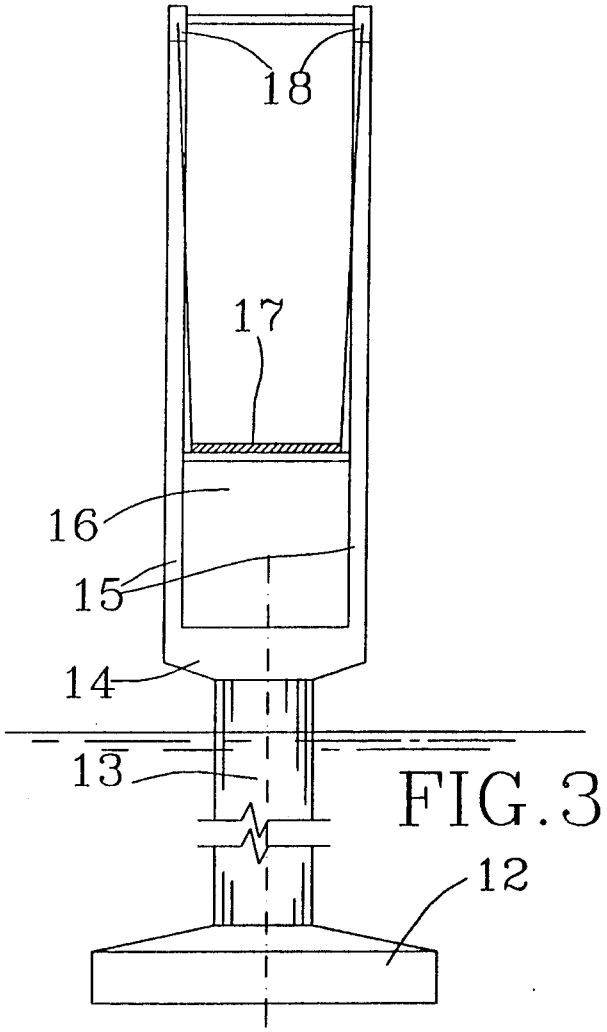
FIG. 3 is a side view of such tower.

FIGS. 1(*a*), (*b*) and (*c*) shows a series of towers 10*a*, 10*b*, 10*c* and 10*d* spaced apart and erected to extend across a body of water 11. Each tower, as shown in FIGS. 2 and 3, consists of a footing 12 supporting a cylindrical pier 13 that projects above the water line to support a pier cap 14. Extending up from the pier cap 14 are four tower legs 15 to form a pylon. In the side view (FIG. 3) the legs 15 are parallel and define a space 16 between them, while in front view (FIG. 2) they firstly diverge from each other to a level at which a deck 17 is located, and then converge to meet at a pair of interconnected head members 18 to which the upper ends of cables 19 are secured in the usual manner.

Figure 4:
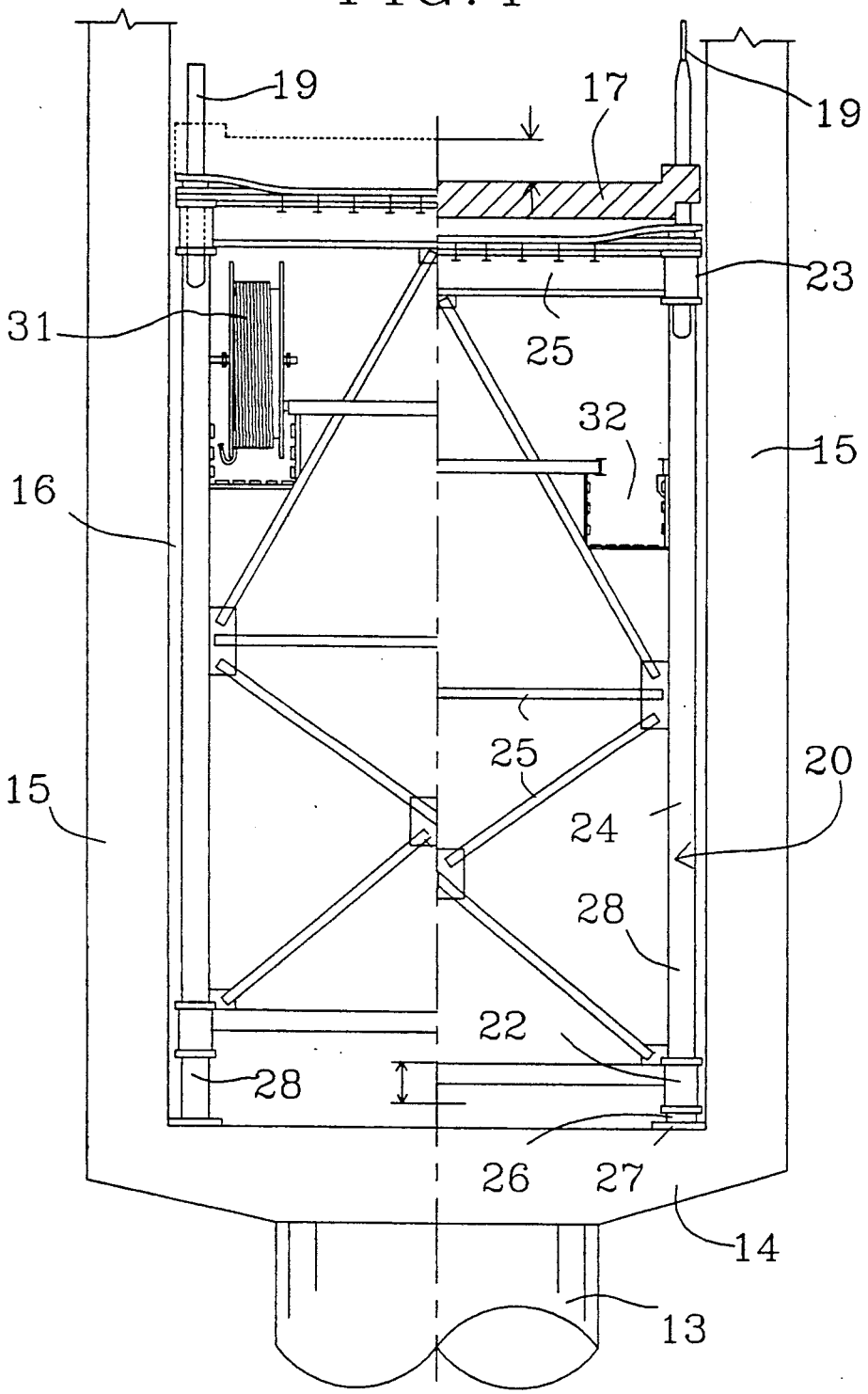
FIG. 4 is a side view of a central portion of the tower on an enlarged scale with a truss mounted therein.
Figure 5:
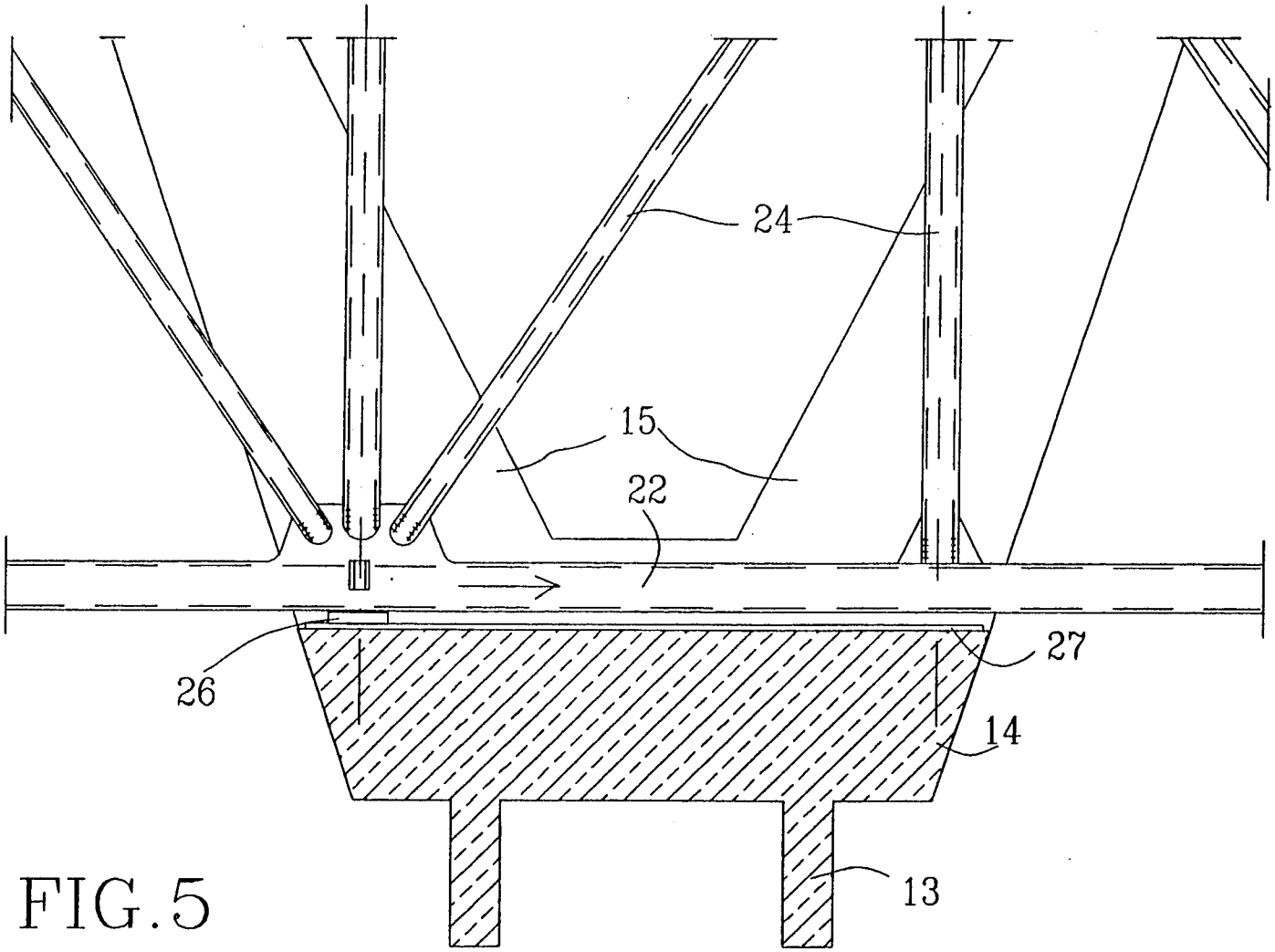
FIG. 5 is a front view of the parts seen in FIG. 4.
Figure 7:
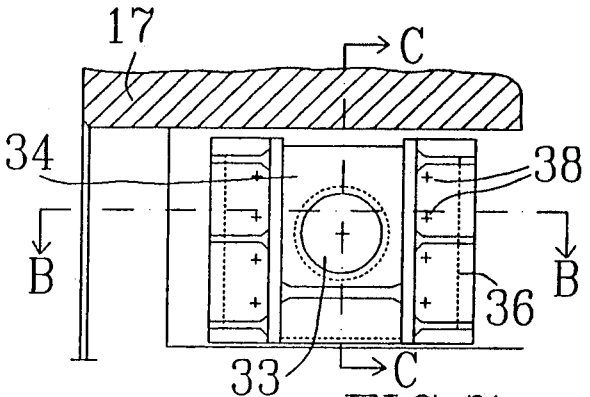
FIG. 7 is a section on A—A of FIG. 6.
Figure 8:
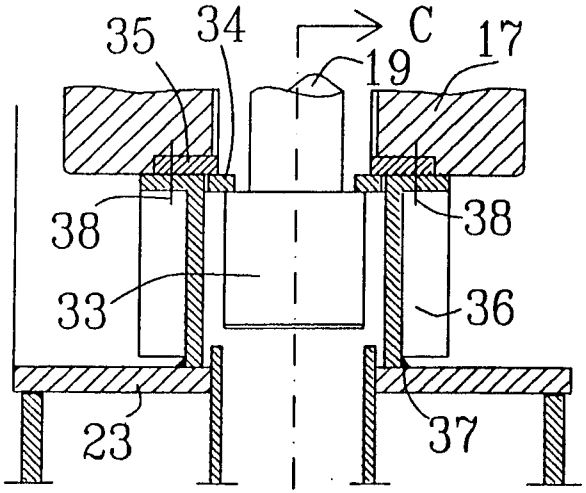
FIG. 8 is a section on B—B of FIG. 6 or 7.
Figure 6:
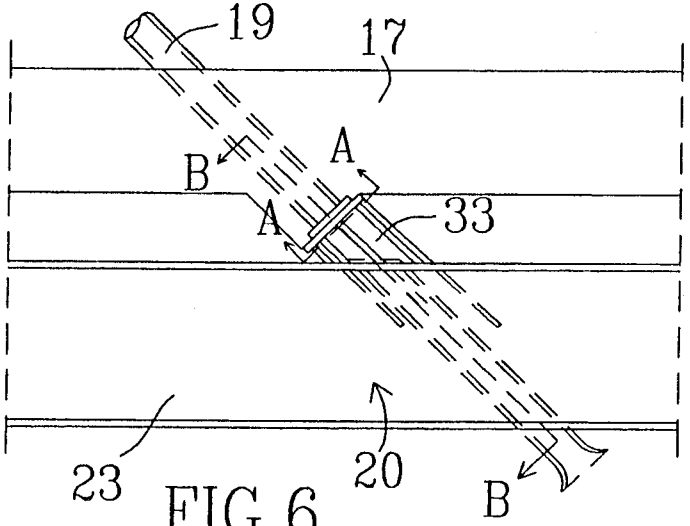
FIG. 6 is a detail view illustrating temporary anchoring of a cable to the truss.
Figure 9:
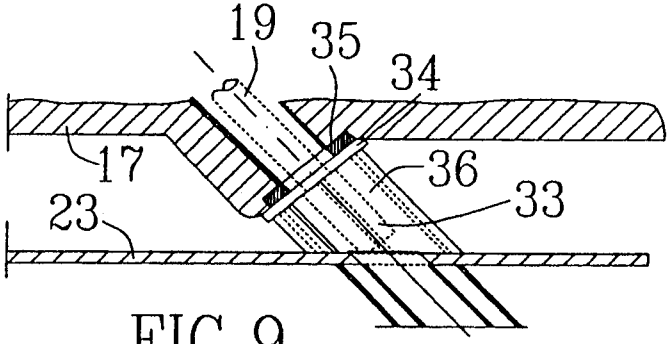
FIG. 9 is a section on C—C of FIG. 7 or 8.

As seen in general terms in FIGS. 1(*a*), (*b*) and (*c*), and in more detail in FIGS. 4 and 5, the space 16 defined in each tower receives an elongated truss 20 that is slidingly supported by at least two towers. In FIG. 1(*a*) the truss extends from tower 10*a*, through towers 10*b* and 10*c*. At each end, the truss has an air filled tank 21 that can be raised and lowered into the water. When in use each of these tanks will preferably be fully submerged in order to provide a constant uplift force on the truss end. By fully submerging the tanks, the uplift forces remain constant, independent of water level, wave action or tidal changes. Alternatively, barges can be used to provide support for the truss. If the bridge is being built over land, other suitable supporting devices can be used instead of the tanks or barges.

FIGS. 1(*a*) and (*b*) illustrate how the truss 20 is launched (using hydraulic jacks not shown) beyond the tower 10*c* to engage the tower 10*d*, which at this stage is only partly formed but already includes the pier cap 14 on which the truss end will rest. The truss 20 consists of the usual bottom and top chords 22, 23, side members 24 and top, bottom and intermediate cross struts 25. The right hand side of FIG. 4 and FIG. 5 show the truss 20 in its launching position in tower 10*c*. The left hand side of FIG. 4 shows the truss in an elevated (casting) position that will be described below. The bottom chords 22 carry teflon bearings 26 that slide on tracks 27 on the upper surface of the pier cap 14. These bearings move with the truss across the pier cap. Once the end of the pier cap is reached, the launching is stopped, the truss lifted (say by 10–20 mm) and the bearing is moved back to the first end of the pier cap.

When the truss has reached the position shown in FIG. 1(*b*), the tanks 21 are raised and the truss is moved further longitudinally and elevated (by 0.5 m to 1.0 m) to bring it into its casting position, as shown on the left hand side of FIG. 4 and in FIG. 1(*c*), by means of hydraulic jacks 28. Note that the trailing portion 20*a* of the truss 20, i.e. the portion extending half way from tower 10*b* to tower 10*c* in FIG. 1(*c*) is less high than the remainder of the truss.

In this elevated condition the truss serves as a support for constructing a deck, e.g. as a support for formwork for making a concrete (or composite) deck 17 of the bridge superstructure, cantilevering half the span length on each side of the tower 10*c*. By virtue of the elevation of the truss, the deck is constructed at an elevation that is higher than the final deck elevation. In FIG. 1(*c*) the pouring level is shown at 17*a*, while the level of the deck portion formed previously is shown producing a deck portion 17. While the reinforcement and prestressing steel is placed on the forms to make the deck, the stay cables 19 are installed and temporarily anchored to the top chords 23 of the truss 20 by means of a cable anchor 33 that engages a plate 34 that bears against a plate 35 embedded in the underside of the deck 17. The temporary anchoring to the truss is achieved by a bracket 36 welded at 37 to the upper flange of the top chord 23 and bolted at 38 to the plate 35 (FIGS. 6–9). The stay cables 19 close to the pylon may be slack when installed because of the elevated position of the formwork while in the casting position. Other cables 19 will have to be stressed to a certain level (less than the final stress) at this stage. These cables will support the truss after their installation and will therefore reduce the forces on the truss generated by the weight of the deck concrete. During the pouring and hardening of the concrete deck, the installation of the stay cables will continue. After the concrete has reached sufficient strength the cables will be anchored directly to the concrete deck without intermediate anchorage to the top chord 23 of the steel truss 20, i.e. by releasing the bolts 38.

After the deck concrete has reached sufficient strength (say after 5 to 10 days) the temporary anchoring of the cables is removed and the truss and the deck are lowered. As the deck is lowered the cable forces will be increased, and, upon reaching a certain level, the deck will be fully supported by the cables. As the truss (and the forms it supports) is lowered further, the deck (now at level 17) will be freely suspended and the truss (and with it the forms) can be launched in the direction of the next span to be built, i.e. to repeat the process.

While the work on the deck is proceeding, the next tower, e.g. tower 10*d*, at the front end of the truss can be completed to become a pylon. Derrick cranes 30 moving on tracks on top of the truss will facilitate completion of the pylon, and may be assisted by floating cranes.

In the casting position, before pouring of the concrete, the bottom forms may serve as access roads for trucks supplying the material (reinforcing bars and prestressing tendons, etc.) to the desired location.

Casting of the deck will preferably start at the tower and progress symmetrically to both sides of the tower to create balanced conditions.

The stay cables are installed from inside the truss. Cable drums 31 (FIG. 4) are lowered into the truss from the completed bridge and moved to the desired location inside the truss on tracks provided for this purpose. Numeral 32 shows a cat walk in the truss.

We claim:

1. In a method of constructing a cable-stayed bridge the steps of (a) erecting a truss on a tower, (b) extending at least one stay cable from an elevated location on the tower to a temporary connection to the truss, (c) constructing a deck on the truss and effecting a connection of the cable to the deck, (d) disconnecting the cable from the truss, and (e) lowering the truss and hence the deck to tension the cable.

2. A method according to claim 1, wherein the truss has one end portion of lesser height than the remainder of the truss.

3. A method of constructing a cable-stayed bridge extending between at least three towers, comprising (a) locating a horizontally extending truss to extend from a first said tower, through a second said tower to a third said tower, (b) extending a plurality of stay cables from an elevated location on the second tower to a series of temporary connections to the truss on the two sides of the second tower extending towards the first and third towers, (c) constructing a deck extending along the truss on said two sides of the second tower, and connecting the cables to the deck, (d) disconnecting the cables from the truss, and (e) lowering the truss and hence the deck relative to the second tower to cause the cables to support the weight of the deck and to acquire desired tensional stresses.

4. A method according to claim 3, wherein the truss is of such a length as to span between said three towers.

5. A method according to claim 3, wherein the truss is mounted for longitudinal sliding through one said tower towards another said tower.

6. A method of constructing a cable-stayed bridge extending between at least three towers, comprising (a) causing a horizontally extending truss spanning from a first said tower to a second said tower to be moved longitudinally to be projected from the second tower to a third said tower to span between the latter towers while continuing to span between the first and second towers, (b) elevating the truss relative to the second tower, (c) extending a plurality of stay cables from an elevated location on the second tower to a series of temporary connections to the truss on the two sides of the second tower respectively extending towards the first and third towers, (d) constructing a first deck portion extending along the truss on said two sides of the second tower, and connecting the cables to the deck portion, (e) disconnecting the cables from the truss, and (f) lowering the truss and hence the deck portion relative to the second tower to cause the cables to support the weight of the deck portion and acquire desired tensional stresses.

7. A method according to claim 6, wherein construction of the deck portion takes place substantially symmetrical on said two sides of the second tower.

8. A method according to claim 6, including completing construction of the third tower while constructing the deck portion adjacent the second tower.

9. A method according to claim 6, including (g) subsequently causing the truss to be moved further longitudinally to be projected from the third tower to a fourth said tower to span between the third and fourth towers while continuing to span between the second and third towers, (h) elevating the truss, (i) extending a further plurality of stay cables from an elevated location on the third tower to a series of temporary connections to the truss on the two sides of the third tower respectively extending towards the second and fourth towers, (j) constructing a further portion of deck extending along the truss on said two sides of the third tower, and connecting said further cables to the further deck portion, (k) disconnecting the further cables from the truss, and (l) lowering the truss and hence the further deck portion to cause the further cables to support the weight of the further deck portion and acquire desired tensional stresses while aligning the further deck portion as a horizontal continuation of the first deck portion.

10. A method according to claim 3, wherein a trailing portion of the truss is of lesser height than the remaining portion of the truss to enable the truss to be elevated for construction of said further deck portion while remaining clear of the already constructed and lowered first deck portion.

11. A method according to claim 6, including providing support for cantilevered ends of the truss during longitudinal movement of the truss.

12. A method according to claim 11, wherein said support is provided by air filled tanks depending from the truss for submergence in a body of water over which the bridge is being constructed.

13. A method according to claim 12, wherein the tanks are located near the ends of the truss.

* * * * *